US011598071B2

(12) United States Patent
Jäggle

(10) Patent No.: US 11,598,071 B2
(45) Date of Patent: Mar. 7, 2023

(54) FLUID SUPPLY SYSTEM FOR SUPPLYING MULTIPLE FLUID CONSUMERS OF A MOTOR VEHICLE WITH FLUID

(71) Applicant: Schwäbische Hüttenwerke Automotive GmbH, Aalen-Wasseralfingen (DE)

(72) Inventor: Gerd Jäggle, Ettingen (DE)

(73) Assignee: Schwäbische Hüttenwerke Automotive GmbH, Aalen (DE)

( * ) Notice: Subject to any disclaimer, the term of this patent is extended or adjusted under 35 U.S.C. 154(b) by 125 days.

(21) Appl. No.: 17/144,451

(22) Filed: Jan. 8, 2021

(65) Prior Publication Data

US 2021/0214921 A1 Jul. 15, 2021

(30) Foreign Application Priority Data

Jan. 13, 2020 (DE) ..... 10 2020 100 583.0

(51) Int. Cl.
*F15B 11/17* (2006.01)
*E02F 9/22* (2006.01)

(52) U.S. Cl.
CPC ..... *E02F 9/2296* (2013.01); *E02F 9/2239* (2013.01); *E02F 9/2292* (2013.01);
(Continued)

(58) Field of Classification Search
CPC ..... F15B 11/162; F15B 11/17; F15B 2211/20576; F15B 2211/20584;
(Continued)

(56) References Cited

U.S. PATENT DOCUMENTS 5,020,324 A * 6/1991 MacDonald ..... F04B 49/007 417/252
5,615,553 A * 4/1997 Lourigan ..... F15B 11/162 60/486

(Continued)

FOREIGN PATENT DOCUMENTS

CN 105317769 A 2/2016
CN 106051131 A 10/2016

(Continued)

OTHER PUBLICATIONS

German Search Report issued in German Patent Application No. 10 2020 100 583.03, dated Nov. 12, 2020, 7 pages.

(Continued)

*Primary Examiner* — Michael Leslie
(74) *Attorney, Agent, or Firm* — RatnerPrestia

(57) ABSTRACT

A fluid supply system supplying multiple fluid consumers of a vehicle with fluid, the fluid supply system including: a first pump supplying a first fluid consumer, arranged in a first supply circulation of the vehicle, with fluid; a second pump supplying a second fluid consumer, arranged in a second supply circulation of the vehicle, with fluid; and a directional control valve adjustable between a first valve position and at least one other, second valve position and preferably includes an electromagnetic device for adjusting. The directional control valve allows the fluid to be delivered from the second pump into the first supply circulation in the first valve position and separates the first supply circulation from the second pump, or allows the fluid to be delivered from the second pump into the first supply circulation only to a restricted extent as compared to the first valve position, in the second valve position.

20 Claims, 2 Drawing Sheets

(52) U.S. Cl.
CPC ..... *F15B 11/17* (2013.01); *F15B 2211/20576* (2013.01); *F15B 2211/20584* (2013.01); *F15B 2211/30535* (2013.01); *F15B 2211/31547* (2013.01)

(58) Field of Classification Search
CPC ..... F15B 2211/20592; E02F 9/2239; E02F 9/2242; E02F 9/2292; F01M 1/02; F01M 1/06; F01M 1/12; F01M 2001/123
See application file for complete search history.

(56) References Cited

U.S. PATENT DOCUMENTS

| | | | | |
|---|---|---|---|---|
| 6,789,658 | B2 | 9/2004 | Busold et al. | |
| 7,047,931 | B2 * | 5/2006 | Sluka | F16H 61/0031 123/198 C |
| 7,107,870 | B2 * | 9/2006 | Kuhstrebe | F16H 57/0473 74/335 |
| 7,946,402 | B2 | 5/2011 | Gassmann et al. | |
| 8,516,811 | B2 * | 8/2013 | Oka | F15B 11/17 60/429 |
| 9,108,670 | B2 * | 8/2015 | Vigholm | E02F 9/225 |
| 9,903,468 | B2 * | 2/2018 | Hwang | F16H 61/0206 |
| 2010/0287924 | A1 * | 11/2010 | Dostal | F15B 11/17 60/430 |
| 2012/0060488 | A1 * | 3/2012 | Grethel | F16H 61/0025 60/484 |
| 2012/0141302 | A1 * | 6/2012 | Hwang | F16H 61/0025 417/244 |
| 2015/0368879 | A1 | 12/2015 | Peterson et al. | |
| 2020/0182268 | A1 * | 6/2020 | Mueter | F15B 11/17 |

FOREIGN PATENT DOCUMENTS

| | | | |
|---|---|---|---|
| DE | 4108915 | A1 | 9/1992 |
| DE | 10143833 | A1 | 3/2003 |
| DE | 102005014654 | A1 | 10/2006 |
| DE | 102015206785 | A1 | 10/2016 |
| DE | 102016107704 | A1 | 10/2017 |
| EP | 0811765 | B1 | 8/2002 |
| EP | 1722121 | A1 | 11/2006 |
| WO | 2017193170 | A1 | 11/2017 |

OTHER PUBLICATIONS

Chinese Office Action for Chinese Application No. 202110044509.6, dated Apr. 24, 2022, with translation, 16 pages.

* cited by examiner

FLUID SUPPLY SYSTEM FOR SUPPLYING MULTIPLE FLUID CONSUMERS OF A MOTOR VEHICLE WITH FLUID

CROSS REFERENCE TO RELATED APPLICATION

This application claims benefit of priority from German Patent Application Application No. 10 2020 100 583.0, filed Jan. 13, 2020. The contents of this application are incorporated herein by reference.

FIELD OF THE INVENTION

The invention relates to a fluid supply system for supplying multiple fluid consumers of a motor vehicle with fluid.

BACKGROUND

Vehicles comprising internal combustion engines can comprise a lubricating oil circulation, for lubricating the engine with lubricating oil, and a cooling circulation for cooling the engine, for example for cooling pistons of the engine. Typically, one of these circulations branches off from the other. For internal combustion engines with variable valve control timing, a supply circulation for adjusting the phase position of the camshaft relative to the crankshaft is also provided. Additionally or instead, the drive motor can also have the option of adjusting the connecting rod length, and the vehicle can comprise a supply circulation for adjusting the connecting rod. Additionally, one or more supply circulations for supplying one or more transmissions, for example an automatic transmission and/or a steering transmission, is/are typically provided in order to be able to fluidically operate the respective transmission. Electric vehicles or hybrid vehicles also have supply circulations for cooling the drive motor, cooling batteries and/or operating one or more transmissions.

The different supply circulations typically place different demands on the volume flows and/or pressures to be provided. A correspondingly large pump can be used to meet different demands. The required pressures and volume flows can be set with the aid of valves. Due to its dimensions, however, the common pump provides a volume flow and/or pressure which is too large and/or high for one or more of the jointly supplied supply circulations, such that part of the fluid is discharged, with losses, into a reservoir for the fluid.

In order to reduce the energy losses resulting from discharging into the reservoir, a main pump and an auxiliary pump can be used, wherein the auxiliary pump is switched in when needed, such that the main pump can be configured to a smaller delivery volume. An auxiliary pump which is driven by and therefore in a fixed rotational speed relationship to the drive motor is switched in and out with the aid of valves via which fluid which is still being delivered surplus to requirement is withdrawn to the reservoir or needlessly conveyed in a smaller circulation bypassing the reservoir. In order to increase the efficiency of a fluid supply system comprising a main and auxiliary pump, the main pump and/or auxiliary pump can be embodied to exhibit an adjustable delivery volume. Alternatively, the auxiliary pump can be driven independently of the drive motor of the vehicle by means of a comparatively small electric motor assigned to the auxiliary pump.

SUMMARY OF THE INVENTION

An aspect of the invention aims to supply two or more fluid consumers of a motor vehicle with fluid, in accordance with the requirements of the respective fluid consumer, with a high degree of efficiency.

In order to supply each of a first fluid consumer and a second fluid consumer of a motor vehicle with fluid, an aspect of the invention proposes a fluid supply system comprising a first pump and at least one other, second pump. The first pump is used to supply the first fluid consumer, which is arranged in a first supply circulation, at a first volume flow and a first supply pressure of the fluid. The second pump is used to supply the second fluid consumer, which is arranged in a second supply circulation, at a second volume flow and a second supply pressure of the fluid. The first fluid consumer can be an individual component, for example a piston of an internal combustion engine which is to be cooled using the fluid, or an assembly composed of multiple components, such as for example a drive motor or a transmission of the motor vehicle. The same applies in relation to the second fluid consumer which can correspondingly be an assembly composed of multiple components or an individual component. In any case, the first and second fluid consumers are different fluid consumers. Where relevant to the fluid supply system, these fluid consumers can in particular differ from one another in relation to their required volume flow and/or supply pressure.

The fluid can in particular be a hydraulic fluid. It can be an oil for lubricating and/or cooling a drive motor or one or more components of a drive motor or transmission and/or a working oil for operating one or more transmissions and/or one or more setting devices of an engine of the vehicle. One typical fluid consumer of a motor vehicle is the drive motor itself, which must be lubricated and/or cooled at different locations using the fluid, wherein the drive motor can be embodied as an internal combustion engine or an electric motor. Internal combustion engines can also comprise fluid consumers having specific requirements, for example one or more pistons to be cooled using the fluid and/or one or more camshaft setters to be operated using the fluid, in each case in order to adjust the phase position of a camshaft relative to a crankshaft, and/or one or more connecting rod adjusters to be operated using the fluid, in each case in order to adjust the length of one or more connecting rods. The first fluid consumer and/or the second fluid consumer can also be components or sub-assemblies of a transmission or of different transmissions of the vehicle.

If, for example, the first fluid consumer is a drive motor of the vehicle which is embodied as an internal combustion engine, the first circulation can be the lubricating oil supply circulation of the drive motor. In such cases, the second fluid consumer can be formed by one or more pistons of the drive motor which are to be cooled. In such cases, the second supply circulation is correspondingly a piston cooling circulation. Alternatively, the second circulation can for example be a supply circulation for one or more phase setters for adjusting the phase position of one or more camshafts of the drive motor. In yet another alternative, the second supply circulation can be a circulation for supplying one or more connecting rod adjusters, in each case for adjusting the length or lengths of one or more connecting rods of the drive motor. In another alternative, the first supply circulation can be a first cooling circulation for cooling an internal combustion engine of a hybrid vehicle, and the second supply circulation can be a second cooling circulation for cooling an electric motor and/or a battery of the hybrid vehicle, wherein the internal combustion engine, the electric motor and the battery are used to drive the hybrid vehicle.

In addition to the pumps, the fluid supply system comprises a directional control valve which is arranged downstream of the second pump. The directional control valve can be switched between a first valve position and at least one other, second valve position, i.e. it can adjusted back and forth. In the first valve position, it allows the fluid to be delivered from the second pump into the first circulation. In the second valve position, it separates the first supply circulation from the second pump or allows the fluid to be delivered from the second pump into the first supply circulation only to a restricted extent as compared to the first valve position.

In first embodiments, the directional control valve can be arranged in the second supply circulation. In the first embodiments, it can be designed to allow the fluid to be delivered from the second pump to the second fluid consumer, arranged in the second supply circulation, in the second valve position and/or an optionally additional valve position, in this case a third valve position. The directional control valve can comprise one or more other valve positions. In simple and—not least for this reason—preferred embodiments, however, it exhibits only two different valve positions, namely the first valve position and the second valve position. The directional control valve can in particular be embodied as a 3/2-port valve.

In second embodiments, the directional control valve is not arranged directly in the second supply circulation, but merely connected to the second supply circulation in such a way that the fluid does not have to flow through the directional control valve in the direction of the second fluid consumer, but the delivery of the fluid to the second fluid consumer can nonetheless be influenced in accordance with requirements by means of the directional control valve. In the second embodiments, and also in the first embodiments, the fluid supply system comprises a connecting line which branches off from the second supply circulation at a junction downstream of the second pump and upstream of the second fluid consumer, in order to be able to connect the first supply circulation to the second supply circulation. In the second embodiments, the directional control valve is arranged downstream of the junction in the connecting line. In the first valve position, it accordingly allows the fluid to be delivered from the second pump into the first supply circulation. In the second valve position, it can interrupt the connecting line, as is preferred, in order to separate the first supply circulation from the second pump, or at least act as a throttle. As explained with respect to the first embodiments, the directional control valve in the second embodiments can again comprise one or more other valve positions but can again preferably be switched between only two different valve positions, namely the first valve position and the second valve position. In the second embodiments, the directional control valve can advantageously be embodied very simply as a 2/2-port valve. The second fluid consumer is then permanently supplied with the fluid. The pressure for the second fluid consumer can be altered, advantageously switched, between the first supply pressure and the second supply pressure by the directional control valve.

Since the second pump can be connected to the first circulation by means of the directional control valve, which advantageously occurs when the second fluid consumer does not require any fluid or only requires fluid at a volume flow and/or pressure which is/are smaller than can be provided by the second pump, the second pump can deliver into the first circulation in such operating phases of the second fluid consumer in order to assist the first pump. The fluid delivered by the second pump does not have to be delivered, with losses, into a reservoir or conveyed in a smaller circulation in an idle circulation, so to speak. This at least temporary assistance relieves the first pump in two ways. On the one hand, it can be completely relieved of supplying the second fluid consumer, and on the other hand, it can be partially relieved of supplying the first fluid consumer. Because it is relieved of the second fluid consumer, the first pump can be dimensioned to have a smaller delivery volume than a pump which additionally also has to supply the second fluid consumer. If the delivery volume of the first pump is adjustable, its delivery volume can be reduced in its assisted phases, in accordance with the degree of assistance, and the drive output required to drive the first pump can consequently be reduced.

The "delivery volume" is understood to mean the specific delivery volume, i.e. the delivery volume per revolution or linear stroke of the respective pump. The first pump and the second pump are preferably each embodied as rotary pumps. In principle, however, one or both pumps can also be embodied as linear stroke piston pumps.

The fluid supply system is in particular advantageous in applications in which one of the supply circulations, for example the first supply circulation, has to be supplied at a greater volume flow than the other supply circulation and/or one of the supply circulations, for example the second supply circulation, has to be supplied at a higher pressure than the other supply circulation. The pump which is assigned to the supply circulation having the higher volume flow requirement can be configured to a higher delivery volume than the other pump. The pump which has to provide the higher pressure can be configured to a higher mechanical robustness and/or to a lower leakage flow, for example to tighter tolerances and tolerance chains, than the other pump. The first pump can then for example be configured to a higher delivery volume than the second pump, and/or the second pump can be configured to deliver the fluid at a higher pressure than the first pump.

If one or both pumps is/are rotary pumps, the respective pump can for example be embodied as an externally toothed wheel pump, an internally toothed wheel pump, a pendulum-slider pump or a vane cell pump. If the delivery volume of one or both pumps can be adjusted, the respective pump is embodied as a vane cell pump In alternative embodiments, since the delivery volume of such pumps can be adjusted comparatively easily and precisely. If one or both pumps is/are embodied as fixed displacement pumps, the respective pump is a toothed wheel pump in preferred embodiments. Toothed wheel pumps, in particular externally toothed wheel pumps, are simple to construct and comparatively robust mechanically. If one of the circulations has to be supplied at a higher pressure than the other circulation, the pump which is at least primarily assigned to the circulation having the higher pressure requirement can in particular be a toothed wheel pump.

The directional control valve can advantageously be designed such that it separates the second fluid consumer from the second pump in at least one valve position. This at least one valve position can in particular be the first valve position. In principle, however, the directional control valve can also exhibit one or more other valve positions and for example be embodied as a 3/3-port valve or a 4/3-port valve, and separate the second fluid consumer from the second pump in a third valve position.

In preferred embodiments, the directional control valve is designed to separate the second pump from the first supply circulation in at least one valve position. This at least one valve position can in particular be the second valve position. In principle, however, the directional control valve can exhibit one or more other valve positions, for example a third valve position or as applicable even a fourth valve position, and separate the second pump from the first circulation in this other valve position.

Preferably, the directional control valve interrupts the connection between the second pump and the second fluid consumer in the first valve position and interrupts the connection between the second pump and the first circulation in the second valve position. Conversely, however, embodiments can also be implemented in which the directional control valve does not completely interrupt the volume flow in the direction of the second fluid consumer in the first valve position but merely throttles it as compared to the second valve position and/or does not completely interrupt the volume flow to the first circulation in the second valve position but merely throttles it as compared to the first valve position.

In advantageous embodiments, the directional control valve is an electromagnetic valve. In such embodiments, it comprises a reciprocating valve piston, a valve spring which exerts a spring force on the valve piston, and an electromagnetic device for generating an electromagnetic force which acts counter to the spring force. The electromagnetic device can be connected to a superordinate controller, for example an engine controller of the motor vehicle, and can be controlled by the controller, for example using electrical signals. Although it is in principle conceivable for the directional control valve to additionally also be able to be charged with a fluid pressure, expediently a pressure of the second supply circulation, it is preferably embodied as a purely electromagnetic valve, i.e. charged only by the valve spring and the electromagnetic device.

In developments, the fluid supply system comprises a setting valve which is arranged in the second supply circulation between the second pump and the second fluid consumer and is designed to set the pressure prevailing in the second circulation and preferably limit it to a maximum pressure. The pressure is expediently set, preferably limited, by applying the pressure prevailing in the second supply circulation to the setting valve. In such embodiments, the setting valve is a fluidic valve comprising a reciprocating valve piston, a valve spring which exerts a spring force on the valve piston, and a pressure chamber in which the valve piston can be charged with a fluid setting pressure counter to the spring force. The setting valve can in particular be a purely fluidic valve, i.e. a valve in which the valve position is set solely by the equilibrium between the spring force and the counteracting fluid setting pressure. The fluid setting pressure can be dependent on the pressure of the fluid in the second supply circulation. The fluid setting pressure preferably corresponds to a pressure of the fluid in the second supply circulation, in that fluid is guided from the second supply circulation upstream of the second fluid consumer to the setting valve and applied to the latter as the fluid setting pressure.

Features of an aspect of the invention are also described in the aspects formulated below. The aspects are worded in the manner of claims and can substitute for them. Features disclosed in the aspects can also supplement and/or qualify the claims, indicate alternatives with respect to individual features and/or broaden claim features. Bracketed reference signs refer to an example embodiment illustrated below in figures. They do not restrict the features described in the aspects to their literal sense as such, but do conversely indicate preferred ways of implementing the respective feature.

Aspect 1. A fluid supply system for supplying multiple fluid consumers of a motor vehicle with fluid, the fluid supply system comprising:

(a) a first pump (1) for supplying a first fluid consumer (3), arranged in a first supply circulation (5) of the motor vehicle, with fluid;

(b) a second pump (2) for supplying a second fluid consumer (4), arranged in a second supply circulation (6) of the motor vehicle, with fluid; and (c) a directional control valve (7, 8; 15, 8) which can be adjusted between a first valve position and at least one other, second valve position, (d) wherein the directional control valve (7, 8; 15, 8)

allows the fluid to be delivered from the second pump (2) into the first supply circulation (5) in the first valve position and separates the first supply circulation (5) from the second pump (2), or allows the fluid to be delivered from the second pump (2) into the first supply circulation (5) only to a restricted extent as compared to the first valve position, in the second valve position.

Aspect 2. The fluid supply system according to the preceding aspect, wherein the directional control valve (7, 8) allows the fluid to be delivered in the second supply circulation (6) from the second pump (2) to the second fluid consumer (4) in the second valve position.

Aspect 3. The fluid supply system according to any one of the preceding aspects, wherein the directional control valve (15; 7, 8) allows the fluid to be delivered from the second pump (2) into the first supply circulation (5) and in the direction of the second fluid consumer (4) in the first valve position, such that the second fluid consumer (4) is only supplied at a pressure (P1) which is lower than in the second valve position, or separates the second pump (2) from the second fluid consumer (4).

Aspect 4. The fluid supply system according to any one of the preceding aspects, wherein the directional control valve (7, 8) is arranged downstream of the second pump (2) and upstream of the second fluid consumer (4) in the second supply circulation (6).

Aspect 5. The fluid supply system according to any one of the preceding aspects, wherein the directional control valve (7, 8) comprises a pressure port for the second pump (2), a first working port for the first supply circulation (5), and a second working port located in the second supply circulation (6) and connects the pressure port selectively to either the first working port or the second working port.

Aspect 6. The fluid supply system according to any one of the preceding aspects, wherein the directional control valve (7, 8) is a 3/2-port valve.

Aspect 7. The fluid supply system according to any one of Aspects 1 to 3, wherein a connecting line (11) branches off from the second supply circulation (6) at a junction (11') downstream of the second pump (2) and upstream of the second fluid consumer (4), in order to connect the first supply circulation (5) to the second supply circulation (6), and wherein the directional control valve (15) is arranged downstream of the junction (11') in the connecting line (11).

Aspect 8. The fluid supply system according to the preceding aspect, wherein the directional control valve (15) comprises a pressure port for the second pump (2) and a working port for the first supply circulation (5) and selectively either connects the pressure port to the working port or separates it from the second working port.

Aspect 9. The fluid supply system according to any one of the immediately preceding two aspects, wherein the directional control valve (15) is a 2/2-port valve.

Aspect 10. The fluid supply system according to any one of the preceding aspects, wherein the directional control valve (7; 15) is a controllable electromagnetic valve.

Aspect 11. The fluid supply system according to any one of the preceding aspects, wherein the directional control valve (7; 15) comprises a valve spring (7*a*; 15*a*) which acts on the directional control valve (7; 15) in the direction of one of the valve positions, preferably in the direction of the first valve position.

Aspect 12. The fluid supply system according to the preceding aspect, wherein the directional control valve (7; 15) comprises an electromagnetic device (7*b*; 15*b*) for generating an electromotive force which acts counter to the valve spring (7*a*; 15*a*).

Aspect 13. The fluid supply system according to any one of the preceding aspects, comprising a setting valve (8) for setting a second pressure (P2), which prevails in the second supply circulation, to a predetermined or predeterminable pressure level and preferably for limiting the second pressure (P2) to a maximum value.

Aspect 14. The fluid supply system according to the preceding aspect, wherein the setting valve (8) for setting the second pressure (P2) can be charged with a fluid setting pressure, for example the second pressure (P2).

Aspect 15. The fluid supply system according to the preceding aspect, wherein the fluid setting pressure is dependent on the second pressure (P2).

Aspect 16. The fluid supply system according to the preceding aspect, wherein the fluid setting pressure corresponds to the second pressure (P2).

Aspect 17. The fluid supply system according to any one of the immediately preceding three aspects, wherein the setting valve (8) comprises a valve spring (8*a*) which acts counter to the fluid setting pressure.

Aspect 18. The fluid supply system according to any one of the immediately preceding four aspects, wherein a return line (8*b*) branches off from the second supply circulation (6), preferably downstream of the setting valve (8), and leads into a pressure chamber of the setting valve (8) in order to charge the setting valve (8) with a pressure prevailing in the second supply circulation (6) and preferably to directly charge it with the second pressure (P2) which is to be set.

Aspect 19. The fluid supply system according to any one of Aspects 13 to 17, wherein the setting valve (8) can be adjusted between a first valve position and at least one other, second valve position and allows the fluid to be delivered from the second pump (2) into the first supply circulation (5) in its first valve position and separates the first supply circulation (5) from the second pump (2), or allows the fluid to be delivered from the second pump (2) into the first supply circulation (5) only to a restricted extent as compared to the first valve position, in its second valve position.

Aspect 20. The fluid supply system according to any one of Aspects 13 to 18, wherein the setting valve (8) can be adjusted between a first valve position and at least one other, second valve position and allows the fluid to be delivered from the second pump (2) to the second fluid consumer (4) in its second valve position and allows the fluid to be delivered from the second pump (2) into the first supply circulation (5), in order to set and for example limit the second pressure (P2), in its first valve position.

Aspect 21. The fluid supply system according to Aspect 19 or Aspect 20, wherein the setting valve (8) separates the second pump (2) from the second fluid consumer (4) or allows the fluid to be delivered from the second pump (2) to the second fluid consumer (4) only to a restricted extent as compared to the second valve position when the setting valve (8) assumes its first valve position.

Aspect 22. The fluid supply system according to any one of Aspects 19 to 21, wherein the setting valve (8) separates the second pump (2) from the second fluid consumer (4) when the setting valve (8) assumes its first valve position.

Aspect 23. The fluid supply system according to any one of Aspects 19 to 22, wherein the setting valve (8) comprises a valve spring (8*a*) which acts in the direction of the second valve position of the setting valve (8).

Aspect 24. The fluid supply system according to any one of Aspects 19 to 23, wherein the setting valve (8) separates the second fluid consumer (4) from the directional control valve (7) in its first valve position.

Aspect 25. The fluid supply system according to any one of Aspects 19 to 24, wherein the setting valve (8) separates the first supply circulation (5) from the directional control valve (7) in its second valve position.

Aspect 26. The fluid supply system according to any one of Aspects 19 to 25, wherein the setting valve (8) connects the second fluid consumer (4) to the directional control valve (7) in its second valve position.

Aspect 27. The fluid supply system according to any one of Aspects 19 to 26, wherein the second pump (2) is connected to the first supply circulation (5) when the directional control valve (7; 15) assumes its first valve position and/or the setting valve (8) assumes its first valve position.

Aspect 28. The fluid supply system according to any one of Aspects 19 to 27, wherein the second pump (2) is separated from the first supply circulation (5) only when the directional control valve (7; 15) and the setting valve (8) each assume their second valve position.

Aspect 29. The fluid supply system according to any one of Aspects 13 to 28, wherein the directional control valve (7) separates the setting valve (8) from the second pump (2) in its first valve position.

Aspect 30. The fluid supply system according to any one of Aspects 13 to 29, wherein the directional control valve (7) allows the fluid to be delivered from the second pump (2) into the first supply circulation (5), bypassing the setting valve (8), in its first valve position.

Aspect 31. The fluid supply system according to any one of Aspects 13 to 30, wherein the directional control valve (7) connects the setting valve (8) to the second pump (2) in its second valve position.

Aspect 32. The fluid supply system according to any one of Aspects 13 to 31, wherein the setting valve (8) comprises a pressure port for the second pump (2), a first working port for the first supply circulation (5) and a second working port located in the second supply circulation (6) and connects the pressure port to either the first working port or the second working port.

Aspect 33. The fluid supply system according to the preceding aspect and Aspect 5, wherein the second working port of the directional control valve (7) is connected to the pressure port of the setting valve (8).

Aspect 34. The fluid supply system according to any one of Aspects 13 to 33, wherein the setting valve (8) is arranged in the second supply circulation (6).

Aspect 35. The fluid supply system according to any one of Aspects 13 to 34, wherein the directional control valve (7) and the setting valve (8) are arranged in series in the second supply circulation (6).

Aspect 36. The fluid supply system according to any one of Aspects 13 to 35, wherein the directional control valve (7) is arranged in the second supply circulation (6) upstream of the setting valve (8).

Aspect 37. The fluid supply system according to any one of Aspects 13 to 36, wherein the setting valve (8) is a directional control valve, for example a 3/2-port valve.

Aspect 38. The fluid supply system according to any one of Aspects 13 to 37, wherein the setting valve (8) is a fluidic valve.

Aspect 39. The fluid supply system according to any one of Aspects 13 to 38, wherein the setting valve (8) can be charged with a fluid setting pressure in order to set the second pressure (P2), and the fluid setting pressure can act on the setting valve (8) in the direction of one of the valve positions, preferably in the direction of the first valve position.

Aspect 40. The fluid supply system according to any one of the preceding aspects, comprising a pressure limiting valve (9), which is arranged in the first supply circulation (5), for limiting a first pressure (P1) prevailing in the first supply circulation (5) to a predetermined or predeterminable pressure level and preferably for limiting the first pressure (P1) to a maximum value.

Aspect 41. The fluid supply system according to the preceding aspect, wherein the pressure limiting valve (9) arranged in the first supply circulation (5) can be charged with a fluid setting pressure, for example the first pressure (P1), in order to limit the first pressure (P1).

Aspect 42. The fluid supply system according to the preceding aspect, wherein the fluid setting pressure is dependent on the first pressure (P1).

Aspect 43. The fluid supply system according to the preceding aspect, wherein the fluid setting pressure corresponds to the first pressure (P1).

Aspect 44. The fluid supply system according to any one of Aspects 40 to 43, wherein a return line (9*b*) branches off from the first supply circulation (5), preferably downstream of the pressure limiting valve (9), and leads into a pressure chamber of the pressure limiting valve (9) in order to charge the pressure limiting valve (9) with a pressure prevailing in the first supply circulation (5) and preferably to directly charge it with the first pressure (P1) which is to be set.

Aspect 45. The fluid supply system according to any one of Aspects 40 to 44, wherein the pressure limiting valve (9) arranged in the first supply circulation (5) comprises a valve spring (9*a*) which acts counter to the fluid setting pressure.

Aspect 46. The fluid supply system according to any one of Aspects 40 to 45, wherein the pressure limiting valve (9) arranged in the first supply circulation (5) comprises a pressure port for the first pump (1), a first working port located in the first supply circulation (5) and a second working port connected to a reservoir (R) for the fluid and connects the pressure port to either the first working port or the second working port.

Aspect 47. The fluid supply system according to any one of Aspects 40 to 46, wherein the second pump (2) can be connected to the first supply circulation (5) via the directional control valve (7, 8; 15) downstream of the pressure limiting valve (9) arranged in the first supply circulation (5).

Aspect 48. The fluid supply system according to any one of Aspects 40 to 47, wherein the pressure limiting valve (9) arranged in the first supply circulation (5) is a directional control valve, for example a 3/2-port valve.

Aspect 49. The fluid supply system according to any one of Aspects 40 to 48, wherein the pressure limiting valve (9) arranged in the first supply circulation (5) is a fluidic valve.

Aspect 50. The fluid supply system according to any one of Aspects 40 to 49, wherein the pressure limiting valve (9) arranged in the first supply circulation (5) can be adjusted between a first valve position and at least one other, second valve position and allows the fluid to be delivered from the first pump (1) to the first fluid consumer (3) in its first valve position and allows the fluid to be delivered in the direction of a reservoir (R), preferably directly into the vicinity of the setting valve (8), in order to set and for example limit the first pressure (P1), in its second valve position.

Aspect 51. The fluid supply system according to any one of the preceding aspects, wherein one of the supply circulations (5, 6), preferably the first supply circulation (5), requires a greater volume flow than the other of the supply circulations (5, 6), and one of the pumps (1, 2) which is arranged in the supply circulation (5) which requires the greater volume flow preferably exhibits a greater specific delivery volume than the other of the pumps (1, 2).

Aspect 52. The fluid supply system according to any one of the preceding aspects, wherein the specific delivery volume of one of the pumps (1, 2), preferably the first pump (1), is greater than the specific delivery volume of the other of the pumps (1, 2).

Aspect 53. The fluid supply system according to any one of the preceding aspects, wherein the delivery volume of the first pump (1) and/or second pump (2) can be adjusted.

Aspect 54. The fluid supply system according to any one of the preceding aspects, wherein one of the supply circulations (5, 6), preferably the second supply circulation (6), requires a higher pressure than the other of the supply circulations (5, 6), and one of the pumps (1, 2) which is arranged in the supply circulation (5) which requires the higher pressure can preferably deliver against a higher counter pressure than the other of the pumps (1, 2).

Aspect 55. The fluid supply system according to any one of the preceding aspects, wherein one of the pumps (1, 2), preferably the second pump (2), can deliver against a higher counter pressure than the other of the pumps (1, 2).

Aspect 56. The fluid supply system according to any one of the preceding aspects, wherein at least one of the pumps (1, 2), preferably the second pump (2), is a fixed displacement pump.

Aspect 57. The fluid supply system according to any one of the preceding aspects, wherein the delivery volume of one of the pumps (1, 2), preferably the first pump (1), can be adjusted, and the other of the pumps (1, 2), preferably the second pump (2), is a fixed displacement pump.

Aspect 58. The fluid supply system according to any one of the preceding aspects, wherein at least one of the pumps (1, 2), preferably the first pump (1), is a vane pump, preferably a vane cell pump.

Aspect 59. The fluid supply system according to any one of the preceding aspects, wherein at least one of the pumps (1, 2), preferably the second pump (2), is a toothed wheel pump, preferably an externally toothed wheel pump.

Aspect 60. The fluid supply system according to any one of the preceding aspects, wherein one of the pumps (1, 2), preferably the first pump (1), is a vane pump and the other of the pumps (1, 2), preferably the second pump (2), is a toothed wheel pump.

Aspect 61. The fluid supply system according to any one of the preceding aspects, wherein the first pump (1) comprises a rotatable first delivery member, and the second pump (2) comprises a rotatable second delivery member, and these delivery members are arranged on a common drive shaft (10).

Aspect 62. The fluid supply system according to any one of the preceding aspects, wherein the first delivery member and the second delivery member are arranged such that they can rotate about the same axis of rotation.

Aspect 63. The fluid supply system according to any one of the preceding aspects, wherein the first pump (1) and/or the second pump (2) is/are driven in a fixed, preferably equal, rotational speed relationship by a motor, preferably the assembly (3) arranged in the first supply circulation (5), of the motor vehicle.

Aspect 64. The fluid supply system according to any one of the preceding aspects, wherein the first pump (1) and the second pump (2) are arranged in a common pump housing.

Aspect 65. The fluid supply system according to the preceding aspect, wherein the outside of the pump housing comprises a first suction port for the first pump (1) and a second suction port for the second pump (2).

Aspect 66. The fluid supply system according to any one of the preceding aspects, wherein the first pump (1) and the second pump (2) are connected to a common reservoir (R) on a low-pressure side.

Aspect 67. The fluid supply system according to the preceding aspect, wherein fluid flows off from the first supply circulation (5) and/or from the second supply circulation (6) into the reservoir (R).

Aspect 68. The fluid supply system according to any one of the preceding aspects, comprising a blocking device (12) which is arranged in a connecting line (11) downstream of the directional control valve (7; 15) and upstream of the first supply circulation (5) and which allows fluid to be delivered via the directional control valve (7; 15) in the direction of the first supply circulation (5) only when a pressure is exceeded which is fixedly predetermined or can be set by means of the blocking device (12).

Aspect 69. The fluid supply system according to the preceding aspect, wherein the second fluid consumer (4) is preloaded to a particular pressure by means of the blocking device (12), for example to the pressure which is fixedly predetermined or can be set by means of the blocking device (12).

Aspect 70. The fluid supply system according to any one of the preceding aspects, comprising a blocking device (12) which is arranged in a connecting line (11) downstream of the second pump (2), preferably downstream of the directional control valve (7; 15), and upstream of the first supply circulation (5) and prevents fluid from flowing back in the direction of the second supply circulation (6) and is for example a reflux valve.

Aspect 71. The fluid supply system according to any one of the preceding aspects in combination with Aspect 13, comprising a blocking device (14) which is arranged in a connecting line (13) downstream of the setting valve (8) and upstream of the first supply circulation (5) and prevents fluid from flowing back in the direction of the second supply circulation (6) and is for example a reflux valve.

Aspect 72. The fluid supply system according to any one of the preceding aspects, wherein the first fluid consumer (3) is a drive motor, preferably an internal combustion engine, of the motor vehicle.

Aspect 73. The fluid supply system according to any one of the preceding aspects, wherein the first pump (1) is a lubricating oil pump, and the first supply circulation (5) is a lubricating oil circulation for supplying an internal combustion engine of the motor vehicle with lubricating oil.

Aspect 74. The fluid supply system according to any one of the preceding aspects, wherein the first fluid consumer (3) is a drive motor of the motor vehicle, and at least one of the supply circulations (5, 6) is used to cool the drive motor.

Aspect 75. The fluid supply system according to any one of the preceding aspects, wherein the second fluid consumer (4) is a setting device for adjusting one or more engine components of an internal combustion engine or one or more transmission components of a transmission of the motor vehicle.

Aspect 76. The fluid supply system according to the preceding aspect, wherein one or more camshaft setters for adjusting the phase position of a respective camshaft and/or one or more connecting rod adjusters for adjusting the length of a respective crankshaft connecting rod of the internal combustion engine forms or jointly form the setting device.

Aspect 77. The fluid supply system according to any one of the immediately preceding two aspects, wherein the setting device comprises one or more setting chambers for adjusting the delivery volume of one of the pumps (1, 2), and the setting chamber or at least one of the multiple setting chambers can be pressurized by the second pump.

Aspect 78. The fluid supply system according to any one of the preceding aspects, wherein:

the first fluid consumer (3) is an internal combustion drive engine of the motor vehicle, the first pump (1) is a lubricating oil pump, and the first supply circulation (5) is a lubricating oil circulation for supplying the internal combustion drive engine with lubricating oil;

the second fluid consumer (4) comprises a setting device for adjusting an engine component of the internal combustion drive engine; and the setting device comprises one or more connecting rod adjusters for adjusting the length of a respective crankshaft connecting rod and/or one or more camshaft setters for adjusting the phase position of a respective camshaft of the internal combustion drive engine and/or one or more setting chambers of one of the pumps (1), if its delivery volume can be adjusted.

Aspect 79. The fluid supply system according to the preceding aspect, wherein the setting device for adjusting the engine component, preferably the second fluid consumer (4), is formed by the connecting rod adjuster(s) and/or the camshaft setter(s) and/or the one or more setting chambers.

BRIEF DESCRIPTION OF THE DRAWINGS

Example embodiments of the invention are explained below on the basis of figures. Features disclosed by the example embodiments—each individually and in any combination of features—advantageously develop the subject-matter of the claims, the above aspects and the embodiments also described above. There is shown:

DETAILED DESCRIPTION OF THE INVENTION

Figure 1:
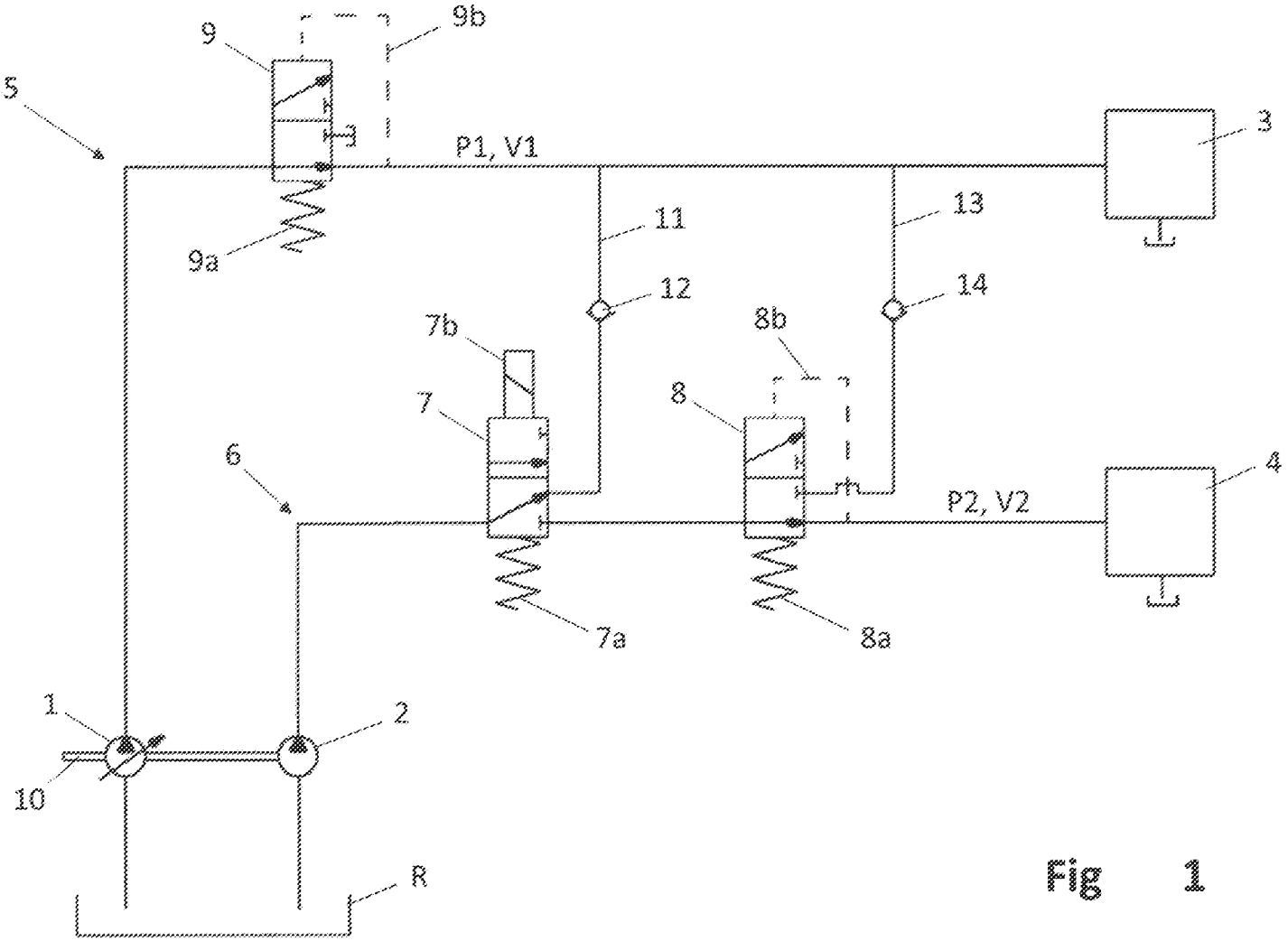
FIG. 1 a fluid supply system of a first example embodiment.

FIG. 1 shows a fluid supply system of a first example embodiment. The fluid supply system comprises a first pump 1 which supplies a first fluid consumer 3 with fluid in a first supply circulation 5. The fluid consumer 3 can for example be an internal combustion engine for driving a motor vehicle. The fluid can in particular be lubricating oil, and the supply circulation 5 can correspondingly be a lubricating oil circulation for supplying the fluid consumer 3 with lubricating oil. The fluid can additionally also be used to cool the fluid consumer 3, for example to cool pistons of the fluid consumer 3 if the latter is embodied as an internal combustion engine. The pump 1 is designed to deliver the fluid in the first circulation 5 at at least a first volume flow V1 and at least a first supply pressure P1. The volume flow V1 and the supply pressure P1 can for example be the volume flow and supply pressure in the main oil gallery of an internal combustion engine. The pump 1 can be designed to solely provide the volume flow and supply pressure required by the fluid consumer 3 for lubrication and/or cooling over the entire operating range of the fluid consumer 3.

As shown, the pump 1 can be one in which the delivery volume can be adjusted, such that a volume flow delivered by the pump 1 can be adapted to an actual requirement of the fluid consumer 3, which varies during operations, by adjusting the delivery volume of the pump 1. The pump 1 can in principle be a linear stroke pump, but is preferably embodied as a rotary pump. Toothed wheel pumps, pendulum-slider pumps and in principle any types of rotary pump design can be used as a rotary pump. The pump 1 is preferably a vane cell pump.

The fluid supply system also comprises a second pump 2 which is used to supply a second fluid consumer 4, arranged in a second supply circulation 6, with the fluid. If the first fluid consumer 3 is an internal combustion engine featuring cooled pistons, the first supply circulation 5 can for example form the lubricating oil circulation, and the second supply circulation 6 can form a piston cooling circulation, i.e. the pump 2 can be used to supply the pistons with the fluid as a coolant. Alternatively, the second fluid consumer 4 can be one or more camshaft setters for adjusting the phase position of one or more camshafts. In another alternative, one or more connecting rod adjusters can (jointly) form the fluid consumer 4. In such embodiments, the fluid is used as a working fluid for operating the respective camshaft setter or connecting rod adjuster. One or more camshaft setters and one or more connecting rod adjusters, and optionally also one or more piston cooling nozzles, can also jointly form the fluid consumer 4. In such embodiments, the respective camshaft setter and the respective connecting rod adjuster can be jointly supplied with the fluid, i.e. pressurized, by means of the second pump 2, preferably via subsequent valves not shown in the figure. In another variant, the second pump 2 can be used to adjust the delivery volume of the first pump 1. If the first pump 1 is embodied as an adjustable pump, as in the example embodiment, and comprises a fluidically operable setting device for adjusting its delivery volume, for example one or more setting chambers within a pump housing, the second fluid consumer 4 can be this setting device of the pump 1 or can comprise the setting device of the pump 1 in addition to the camshaft setter(s) and/or the connecting rod adjuster(s).

The second pump 2 is designed to deliver the fluid at a second volume flow V2 or greater and at a second supply pressure P2 or greater. The supply pressure P2 can in particular be a nominal working pressure for operating one or more camshaft setters and/or one or more connecting rod adjusters and/or one or more piston cooling nozzles and/or a setting device of the pump 1. The volume flow V2 is the volume flow which is established at the supply pressure P2 and which is required for sufficiently supplying the fluid consumer 4. The volume flow V2 can for example be a purely holding flow which is just sufficient in order to compensate for unavoidable leaks.

The second pump 2 can be embodied as a linear stroke pump or, as is preferred, as a rotary pump. When embodied as a rotary pump, it can for example be a toothed wheel pump, in particular an externally or internally toothed wheel pump, or a pendulum-slider pump or a vane cell pump. The second pump 2 is preferably a toothed wheel pump and particularly preferably an externally toothed wheel pump. In simple and—not least for this reason—preferred embodiments, the delivery volume of the pump 2 cannot be adjusted, i.e. the pump 2 is embodied as a fixed displacement pump. In principle, however, it can instead be embodied as a pump in which the delivery volume can be adjusted.

The pumps 1 and 2 deliver the fluid from a common reservoir R. The supply circulations 5 and 6 each exhibit a low-pressure side and a high-pressure side. The low-pressure side of the circulation 5 extends from the reservoir R up to the pump 1. The high-pressure side of the circulation 5 extends from the pump 1 up to the most downstream point of consumption by the fluid consumer 3. As indicated in the figure, the depressurized fluid flows from the fluid consumer 3 back into the reservoir R. The low-pressure side of the circulation 6 extends from the reservoir R up to the pump 2, and the high-pressure side of the circulation 6 extends from the pump 2 up to the one or more points of consumption by the fluid consumer 4. The fluid can, but need not, flow from the fluid consumer 4 back into the reservoir R. The fluid can in particular flow back from the fluid consumer 3 and/or optionally from the fluid consumer 4 due to gravity. In FIG. 1, the fluid is indicated as also flowing back from the second fluid consumer 4 to the reservoir R.

In the second supply circulation 6, a directional control valve 7 is arranged downstream of the pump 2. The directional control valve 7 can be switched between a first valve position and a second valve position. In FIG. 1, the directional control valve 7 assumes the first valve position in which it allows the fluid to be delivered from the second pump 2 into the first circulation 5 and simultaneously separates the fluid consumer 4 from the pump 2. If the directional control valve 7 is adjusted into the second valve position, it allows the fluid to be delivered from the pump 2 to the fluid consumer 4 and simultaneously separates the pump 2 from the first circulation 5.

The directional control valve 7 is embodied as a 3/2-port valve and can therefore only be adjusted back and forth between these two valve positions. In modifications, the directional control valve 7 can be switchable between more than two valve positions. In such embodiments, it can comprise the first and second valve positions described and additionally a third valve position. In the optional third valve position, it can for example connect the pump 2 simultaneously to the second fluid consumer 4 and the first circulation 5 and for example set a particular division ratio. The directional control valve 7 is preferably a switching valve which can only be switched between its different valve positions, but can alternatively also be embodied as a proportional valve, in particular a 3/2-port valve, in order to be able to divide the fluid continuously into partial flows.

The directional control valve 7 comprises a valve spring 7*a* and an electromagnetic device 7*b*. It is correspondingly embodied as an electromagnetic valve. By means of the electromagnetic device 7*b*, the directional control valve 7 can be selectively switched into the different valve positions—in the example embodiment, the two different valve positions—and the fluid consumer 4 can thus be selectively connected to or separated from the second pump 2. Similarly, the pump 2 can be selectively connected to and separated from the first circulation 5 by means of the directional control valve 7. The valve spring 7*a* charges a valve piston of the directional control valve 7 with a spring force which acts in the direction of the first valve position. When a current is applied to it, the electromagnetic device 7*b* acts in the direction of the second valve position, counter to the spring force. When a current is not applied to the directional control valve 7, it assumes the first valve position, as shown. When a current is applied to it, it is switched into the second valve position. The electromagnetic device 7*b* can for example be connected to a superordinate engine controller in order to be able to perform the switching process in accordance with the requirements of the fluid consumer 4.

The fluid supply system also comprises a setting valve 8 which is likewise arranged downstream of the pump 2 and also, as is preferred, downstream of the directional control valve 7 in the second circulation 6. Alternatively, the setting valve 8 can be arranged upstream of the directional control valve 7. The setting valve 8 is used to set the supply pressure P2 for the fluid consumer 4. The setting valve 8 is likewise embodied as a directional control valve, for example as a 3/2-port valve. It can be switched between a first valve position and a second valve position. In the first valve position, it establishes a connection between the second circulation 6 and the first circulation 5 and separates the fluid consumer 4 from the pump 2. In FIG. 1, the setting valve 8 assumes the second valve position in which it separates the pump 2 from the first circulation 5 and allows the fluid to be delivered from the pump 2 to the fluid consumer 4.

The setting valve 8 comprises a valve spring 8*a* which charges a valve piston of the setting valve 8 with a spring force which acts in the direction of the second valve position. The setting valve 8 is embodied as a fluidic valve. A fluid setting pressure, which is dependent on a pressure prevailing in the second circulation 6, acts on the valve piston in the direction of the first valve position, counter to the spring force of the valve spring 8*a*. To this end, a return line 8*b*, via which the fluid exhibiting the pressure P2 is channeled to the valve piston, branches off from the second circulation 6. The fluid setting pressure corresponds at least substantially to the pressure P2. In relation to the setting valve 8, the return line 8*b* can be embodied as an external return line or, as is preferred, as an internal return line 8*b*. The return line 8*b* preferably branches off from the second circulation 6 downstream of the setting valve 8. The setting valve 8 itself can likewise have an electromagnetic device, comparable to the electromagnetic device 7*b*, in order to assist the valve spring 8*a* or, preferably, the fluid setting pressure. In the example embodiment, however, the setting valve 8 is embodied as a purely fluidic valve, with no electromagnetic device, as is preferred. Correspondingly, only the spring force of the valve spring 8*a* and, counter to this, the fluid setting pressure act on its valve piston.

The valve spring 8*a* and the piston face of the valve piston, which the fluid setting pressure acts on, are adjusted to one another such that at most the second supply pressure P2 is established in the second circulation 6 between the regulating valve 8 and the fluid consumer 4. The interplay between the valve spring 8*a* and the feedback fluid pressure thus limits the second supply pressure P2 to a predetermined maximum value. If the pressure P2 exceeds the maximum value, the setting valve 8 moves from the second valve position shown into the first valve position in which it separates the fluid consumer 4 from the pump 2 and instead allows fluid to be delivered into the first circulation 5.

The valves 7 and 8 each comprise an inlet or pressure port and two outlets or working ports. As shown, the pressure port of the directional control valve 7 can be permanently connected to the second pump 2. It can be immediately downstream of the pump 2, or also for example an integral part of the pump 2. One of the working ports of the directional control valve 7 can be connected to the fluid consumer 4—in the example embodiment, via the downstream setting valve 8. The other of the working ports of the directional control valve 7 can be connected to the first supply circulation 5 via a connecting line 11. The pressure port of the setting valve 8 is connected to the second pump 2—in the example embodiment, via the upstream directional control valve 7. The fluid consumer 4 is connected to one of the working ports of the setting valve 8. The other of the working ports of the setting valve 8 is connected to the first supply circulation 5 via a connecting line 13.

A blocking device 12 which is arranged in the connecting line 11 only allows fluid to flow in the direction of the first supply circulation 5 and prevents it from flowing back from the first supply circulation 5 into the second supply circulation 6. The blocking device 12 can in particular be a reflux valve, as shown.

A blocking device 14 which is arranged in the connecting line 13 only allows fluid to flow in the direction of the first supply circulation 5 and prevents it from flowing back from the first supply circulation 5 into the second supply circulation 6. The blocking device 14 can in particular be a reflux valve, as shown.

A pressure limiting valve 9 can be arranged in the first supply circulation 5 in order to limit the first supply pressure P1, in particular when the fluid is cold and therefore viscous if the fluid is an oil. The first pressure P1 can preferably be limited to a predetermined maximum value by means of the pressure limiting valve 9. The pressure limiting valve 9 can be embodied as a directional control valve, for example as a 3/2-port valve. In embodiments in which it is a directional control valve, the pressure limiting valve 9 can be switchable between a first valve position and a second valve position. In the figure, the pressure limiting valve 9 assumes the first valve position in which it allows the fluid to be delivered from the first pump 1 to the fluid consumer 3. In its second valve position, the pressure limiting valve 9 interrupts the connection between the pump 1 and the fluid consumer 3 and instead connects the pump 1 to the reservoir R. The pressure limiting valve 9 comprises a pressure port for connecting to the pump 1, a working port for connecting the fluid consumer 3 and another working port for delivering to the reservoir R. This other port can simply lead into the vicinity of the pressure limiting valve 9, as long as care is taken that the fluid can flow off to the reservoir R via said other working port.

Like the directional control valve 7 and the setting valve 8 before it, the pressure limiting valve 9 comprises a reciprocating valve piston and a valve spring 9*a* which acts on the valve piston. In the example embodiment, the valve spring 9*a* acts on the valve piston in the direction of the first valve position which the pressure limiting valve 9 assumes in the figure. A fluid pressure prevailing in the first circulation 5 acts counter to the valve spring 9*a*. To this end, a return line 9*b*, via which the fluid can be caused to act on the valve piston, branches off from the first supply circulation 5. The pressure limiting valve 9 is embodied as a purely fluidic valve. As is preferred, but merely by way of example, the return line 9*b* branches off from the first circulation 5 downstream of the pressure limiting valve 9. The return line 9*b* can be provided externally with respect to the pressure limiting valve 9 or, more preferably, can be an integral part of the pressure limiting valve 9.

The second pump 2 can be connected to the first supply circulation 5 via the directional control valve 7 and the connecting line 11. The fluid delivered by the pump 2 can advantageously be delivered into the first circulation 5 downstream of the pressure limiting valve 9. To this end, the connecting line 11 is connected to the first circulation 5 downstream of the pressure limiting valve 9.

The pump 2 can be connected to the first supply circulation 5 via the setting valve 8 and the connecting line 13. Preferably, it can be connected to the first circulation 5 downstream of the pressure limiting valve 9, as in the example embodiment. To this end, the connecting line 13 is connected to the first circulation 5 downstream of the pressure limiting valve 9. The connecting line 13 is advantageously connected to the first circulation 5 downstream of the connecting line 11.

The pumps 1 and 2 are driven in a fixed rotational speed relationship by the drive motor of the vehicle, which can be an internal combustion engine or an electric motor. In such embodiments, the pumps 1 and 2 can be driven via drive trains which are separate but respectively exhibit a fixed rotational speed relationship. As is preferred, however, a delivery rotor of the first pump 1 and a delivery rotor of the second pump 2 are arranged coaxially on a common drive shaft 10 which is in turn driven by the drive motor of the vehicle. They are therefore driven in a fixed and equal rotational speed relationship.

The pumps 1 and 2 can comprise separate pump housings. If, however, delivery members are arranged on a common drive shaft, as in the example embodiment, then embodiments in which the pumps 1 and 2 have a common pump housing are also advantageous. If this is the case, the pumps 1 and 2 are separated from one another at least on the outlet side or high-pressure side, i.e. they each comprise an outlet of their own. On the low-pressure side, they can comprise a common inlet or, as is preferred, separate inlets even if they have a common pump housing.

Figure 2:
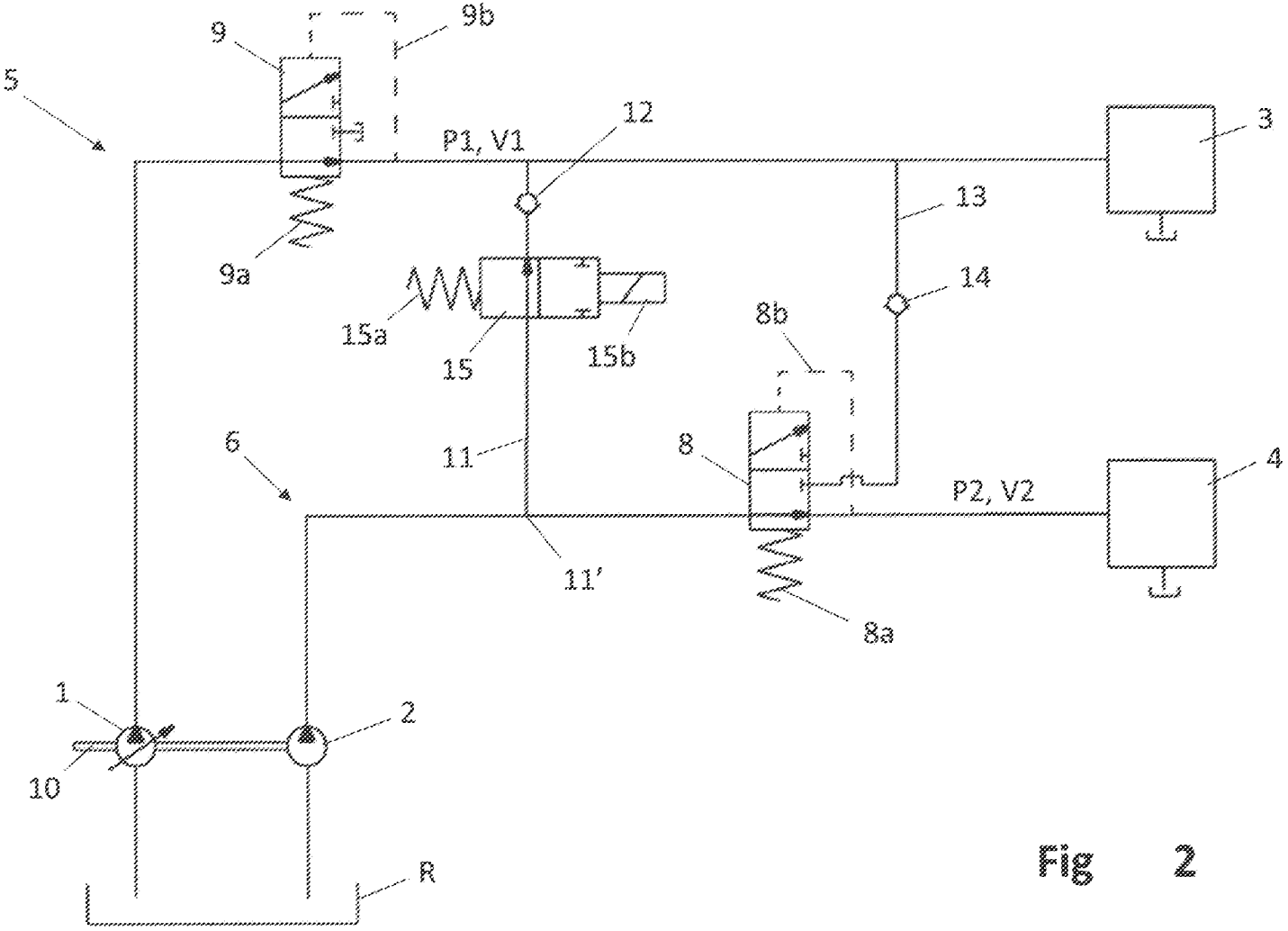
FIG. 2 a fluid supply system of a second example embodiment.

FIG. 2 shows a fluid supply system of a second example embodiment, which differs from the first example embodiment only in the arrangement of the electromagnetically operable directional control valve. In the first example embodiment, the directional control valve 7 can interrupt the connection between the second pump 2 and the second fluid consumer 4. Instead of the directional control valve 7 arranged in the second supply circulation 6, the fluid supply system of the second example embodiment comprises a directional control valve 15 which can influence but not interrupt the delivery of the fluid from the second pump to the second fluid consumer 4. The directional control valve 15 is in this sense arranged outside the second supply circulation 6.

Apart from the arrangement of the directional control valve 15, the fluid supply system of the second example embodiment corresponds to the fluid supply system of the first example embodiment. The pumps 1 and 2, the fluid consumers 3 and 4, the valves 8 and 9, the blocking devices 12 and 14 and the connecting line 13 can thus be formed and arranged exactly as in the first example embodiment. Reference is made in this respect to the statements made with respect to the first example embodiment.

In the second example embodiment, the connecting line 11 branches off from the second supply circulation 6 at a junction 11', and the directional control valve 15 is arranged downstream of the junction 11' in the connecting line 11. The connecting line 11 is connected to the first supply circulation 5 downstream of the directional control valve 15, as in the first example embodiment. A blocking device 12 can be arranged in the connecting line 11 downstream of the directional control valve 15, as in the first example embodiment.

The directional control valve 15 can be adjusted between a first valve position and a second valve position. In the first valve position, the directional control valve 15 allows the fluid to be delivered from the second pump 2 into the first supply circulation 5. In FIG. 2, the directional control valve 15 assumes the first valve position. In the second valve position, it separates the first supply circulation 5 from the second supply circulation 6 and therefore also from the pump 2. Unlike the directional control valve 7 of the first example embodiment, the directional control valve 15 allows the fluid to be delivered from the second pump 2 to the second fluid consumer 4 not only in the second valve position but also in the first valve position. If, however, the directional control valve assumes the first valve position, the fluid delivered from the second pump 2 can flow off into the first supply circulation 5, such that the typically lower supply pressure P1 of the first supply circulation 5 is established in the second supply circulation 6. The fluid consumer 4 can therefore be preloaded with the supply pressure P1. This can be advantageous for shortening the response time if the pressure requirement of the second consumer 4 suddenly rises.

As in the example embodiment, the blocking device 12 can be used to prevent fluid from flowing back from the first supply circulation into the second supply circulation. It can correspondingly be a simple reflux valve. In developments, the preloading pressure which is established in the second supply circulation 6 when the directional control valve 15 assumes the first valve position can be predetermined by means of the blocking device 12. The preloading pressure can be a few bars, for example 5 bars. If the fluid consumer 4 has to be supplied at a higher pressure P2, only the pressure difference between P2 and the preloading pressure has to be accumulated in the second supply circulation 6. The response time of the fluid consumer 4 is correspondingly shortened as compared to the supply of fluid without preloading.

In another development, the blocking device 12 can be designed to alter the preloading pressure in accordance with the second fluid consumer 4 and/or the first fluid consumer 3, i.e. to set it in accordance with requirements. The blocking device 12 can be designed to predetermine a preloading pressure only or to prevent fluid from flowing back into the second supply circulation 6 only. Advantageously, however, it can also be designed to fixedly or variably predetermine a preloading pressure and to prevent fluid from flowing back.

The directional control valve 15 comprises a valve spring 15*a* and an electromagnetic device 15*b*. It is correspondingly embodied as an electromagnetic valve. By means of the electromagnetic device 15*b*, the directional control valve 15 can be selectively switched into the different valve positions—in the example embodiment, the two different valve positions—and the first supply circulation 5 can thus be selectively connected to or separated from the second supply circulation 6. The valve spring 15*a* charges a valve piston of the directional control valve 15 with a spring force which acts in the direction of the first valve position. When a current is applied to it, the electromagnetic device 15*b* acts in the direction of the second valve position, counter to the spring force. When a current is not applied to the directional control valve 15, it assumes the first valve position, as shown in FIG. 2. When a current is applied to it, it is switched into the second valve position. The electromagnetic device 15*b* can for example be connected to a superordinate engine controller in order to be able to perform the switching process in accordance with the requirements of the fluid consumer 4.

The directional control valve 15 can be embodied with two ports only, namely a pressure port and a working port, as in the example embodiment. Its pressure port is connected to the second supply circulation 6 via the connecting line 11, upstream of the setting valve 8 as is preferred. Its working port is connected to the first supply circulation 5, downstream of the pressure limiting valve 9 as is preferred.

The invention claimed is:

1. A fluid supply system for supplying multiple fluid consumers of a motor vehicle with fluid, the fluid supply system comprising:

(a) a first pump for supplying a first fluid consumer, arranged in a first supply circulation of the motor vehicle, with fluid;

(b) a second pump for supplying a second fluid consumer, arranged in a second supply circulation of the motor vehicle, with fluid;

(c) a directional control valve which can be adjusted between a first valve position and at least one other, second valve position; and (d) a setting valve for setting a second pressure, which prevails in the second supply circulation, to a predetermined or predeterminable pressure level, (e) wherein the directional control valve allows the fluid to be delivered from the second pump into the first supply circulation in the first valve position and separates the first supply circulation from the second pump, or allows the fluid to be delivered from the second pump into the first supply circulation only to a restricted extent as compared to the first valve position, in the second valve position, and (f) wherein the setting valve can be adjusted between a first valve position and at least one other, second valve position and allows the fluid to be delivered from the second pump into the first supply circulation in its first valve position and separates the first supply circulation from the second pump, or allows the fluid to be delivered from the second pump into the first supply circulation only to a restricted extent as compared to the first valve position, in its second valve position.

2. The fluid supply system according to claim 1, wherein the directional control valve allows the fluid to be delivered in the second supply circulation from the second pump to the second fluid consumer in the second valve position.

3. The fluid supply system according to claim 1, wherein the directional control valve comprises an electromagnetic device for the purpose of adjusting.

4. The fluid supply system according to claim 1, wherein the directional control valve allows the fluid to be delivered from the second pump into the first supply circulation and in the direction of the second fluid consumer in the first valve position, such that the second fluid consumer is only supplied at a pressure which is lower than in the second valve position, or separates the second pump from the second fluid consumer.

5. The fluid supply system according to claim 1, wherein the directional control valve is arranged downstream of the second pump and upstream of the second fluid consumer in the second supply circulation.

6. The fluid supply system according to claim 1, wherein a connecting line branches off from the second supply circulation at a junction downstream of the second pump and upstream of the second fluid consumer, in order to connect the first supply circulation to the second supply circulation, and wherein the directional control valve is arranged downstream of the junction in the connecting line.

7. The fluid supply system according to claim 1, wherein the setting valve for setting the second pressure can be charged with a fluid setting pressure.

8. The fluid supply system according to claim 1, wherein the setting valve can be adjusted between a first valve position and at least one other, second valve position and allows the fluid to be delivered from the second pump to the second fluid consumer in its second valve position and allows the fluid to be delivered from the second pump into the first supply circulation, in order to set the second pressure, in its first valve position.

9. The fluid supply system according to claim 1, comprising a setting valve for setting a second pressure, which prevails in the second supply circulation, to a predetermined or predeterminable pressure level, wherein the directional control valve and/or the setting valve is/are arranged in the second supply circulation.

10. The fluid supply system according to claim 1, wherein one of the supply circulations requires a greater volume flow than the other of the supply circulations, and one of the pumps which is arranged in the supply circulation which requires the greater volume flow exhibits a greater specific delivery volume than the other of the pumps.

11. The fluid supply system according to claim 1, wherein the delivery volume of one of the pumps can be adjusted, and the other of the pumps is a fixed displacement pump.

12. The fluid supply system according to claim 11, wherein the second pump is the fixed displacement pump.

13. The fluid supply system according to claim 1, wherein one of the pumps is a vane pump and the other of the pumps is a toothed wheel pump.

14. The fluid supply system according to claim 1, wherein the first pump and/or the second pump is/are driven in a fixed rotational speed relationship by a motor of the motor vehicle.

15. The fluid supply system according to claim 1, comprising a blocking device which is arranged in a connecting line downstream of the directional control valve and upstream of the first supply circulation, wherein the blocking device prevents fluid from flowing back in the direction of the second supply circulation and/or allows fluid to be delivered via the directional control valve in the direction of the first supply circulation only when a pressure is exceeded which is fixedly predetermined or can be set by means of the blocking device.

16. The fluid supply system according to claim 15, wherein the second fluid consumer is preloaded to a particular pressure by means of the blocking device.

17. The fluid supply system according to claim 16, wherein the particular pressure is the pressure which is fixedly predetermined or can be set by means of the blocking device.

18. The fluid supply system according to claim 1, wherein:

the first fluid consumer is an internal combustion drive engine of the motor vehicle, the first pump is a lubricating oil pump, and the first supply circulation is a lubricating oil circulation for supplying the internal combustion drive engine with lubricating oil;

the second fluid consumer comprises a setting device for adjusting an engine component of the internal combustion drive engine; and the setting device comprises one or more connecting rod adjusters for adjusting the length of a respective crankshaft connecting rod and/or one or more camshaft setters for adjusting the phase position of a respective camshaft of the internal combustion drive engine and/or one or more setting chambers of one of the pumps, which is adjustable in its delivery volume.

19. The fluid supply system according to claim 7, wherein the fluid setting pressure with which the setting valve for setting the second pressure can be charged is the second pressure.

20. The fluid supply system according to claim 1, wherein the setting valve can be adjusted between a first valve position and at least one other, second valve position and allows the fluid to be delivered from the second pump to the second fluid consumer in its second valve position and allows the fluid to be delivered from the second pump into the first supply circulation, in order to set and limit the second pressure, in its first valve position.

* * * * *